United States Patent [19]

Zidele

[11] 4,365,352

[45] Dec. 28, 1982

[54] REVERSIBLE BASEBALL GLOVE

[76] Inventor: Israel Zidele, 1303 Ditmas Ave., Brooklyn, N.Y. 11226

[21] Appl. No.: 195,942

[22] Filed: Oct. 10, 1980

Related U.S. Application Data

[63] Continuation-in-part of Ser. No. 46,798, Jun. 8, 1979, Pat. No. 4,227,263.

[51] Int. Cl.[3] ..... A41D 13/10

[52] U.S. Cl. ..... 2/19; 2/169

[58] Field of Search ..... 2/19, 16, 2.0, 159, 2/161 R, 161 A, 169, 158, DIG. 2

[56] References Cited

U.S. PATENT DOCUMENTS

| | | | |
|---|---|---|---|
| 1,003,031 | 9/1911 | Cline | 2/19 |
| 2,311,949 | 2/1943 | Latina | 2/19 |
| 2,324,219 | 7/1943 | Latina | 2/19 |
| 2,473,025 | 6/1949 | Gregg | 2/19 |
| 3,300,787 | 1/1967 | Denkert | 2/19 |
| 3,623,163 | 11/1971 | Latina | 2/19 |
| 4,227,263 | 10/1980 | Zidele | 2/19 |

*Primary Examiner*—H. Hampton Hunter
*Attorney, Agent, or Firm*—Karl F. Ross

[57] ABSTRACT

A baseball glove, usable by both right-handed and left-handed players, is formed from a symmetrical blank cut in one piece from a strip of leather or similar sheet material, or from a pair of such blanks, defining one or more single centrally positioned finger stalls flanked by a pair of wings either of which can be shaped into a combination thumb stall and web while the other accomodates the remaining finger or fingers. In one embodiment the web is connected by lacing with the central group, designed to receive the index finger; in another embodiment, six or seven stalls are shiftably interlinked by a single lace, with one or two stalls forming the web on being closely juxtaposed with an adjoining thumb stall. When the glove has front and rear sheets formed from separate blanks, their heel portions may be loosely held together by a wristband.

9 Claims, 5 Drawing Figures

REVERSIBLE BASEBALL GLOVE

CROSS-REFERENCE TO RELATED APPLICATION

This is a continuation-in-part of my copending application Ser. No. 46,798 filed June 8, 1979, now U.S. Pat. No. 4,227,263.

FIELD OF THE INVENTION

My present invention relates to a reversible baseball glove, usable by both right-handed and left-handed players, of the general type disclosed in my above-identified application and patent.

BACKGROUND OF THE INVENTION

As discussed at length in my copending application, it is known to provide a baseball glove with a front piece of tough flexible sheet material, such as leather, and rear sheeting defining therewith a thumb stall and four other finger stalls together with a web between the thumb stall and the finger stall proximal thereto which accomodates a player's index finger or pointer.

OBJECT OF THE INVENTION

The object of my present invention is to provide a further improvement over the glove construction of my copending application and patent in which at least the front piece is of unitary character and can therefore be readily stamped or cut from a single sheet, this front piece being easily adaptable for left-hand or right-hand use.

SUMMARY OF THE INVENTION

In accordance with my present improvement, the front piece consists of an integral preferably seamless blank which in a flattened-out state is symmetrical about a central portion forming part of at least one finger stall, this central portion being flanked by two wings of which one forms part of the thumb stall and the web while the other forms part of at least a stall for the little finger. The web is joined by lacing to the index-finger stall and can thus be quickly separated therefrom when conversion to other-handedness is desired.

The central portion of the front piece may be slitted to define the front parts of three stalls respectively accommodating the index finger, the middle finger and the ring finger of the player. In that instance I prefer to form the rear parts of these three stalls by integral extensions of the front parts folded about transverse edges which come to lie at the tips of the player's fingers.

Alternatively, the rear parts of all the finger stalls including the thumb stall as well as the web may be formed by a second integral blank which, like the first one, is symmetrical about a central portion in its flattened-out state. The two blanks are each slitted into six or seven integrally interconnected sections, five of which are selectable to form finger stalls including a thumb stall; this leaves one or two sections, next to the selected thumb stall, tightly attached to the latter to act as a web. The several sections are permanently interconnected by the aforementioned lacing which can be selectively tightened or slackened to establish the web/-thumb-stall combination on one side and two or three relatively mobile stalls for the ring and little fingers and possibly the middle finger on the other side of one or two intermediate stalls.

A further feature of my invention, applicable especially to a glove with integral front and rear pieces, resides in the provision of a wristband loosely and adjustably interconnecting respective heel protions of these pieces.

BRIEF DESCRIPTION OF THE DRAWING

The above and other features of my invention will now be described in detail with reference to the accompanying drawing in which.

SPECIFIC DESCRIPTION

Figure 1A:
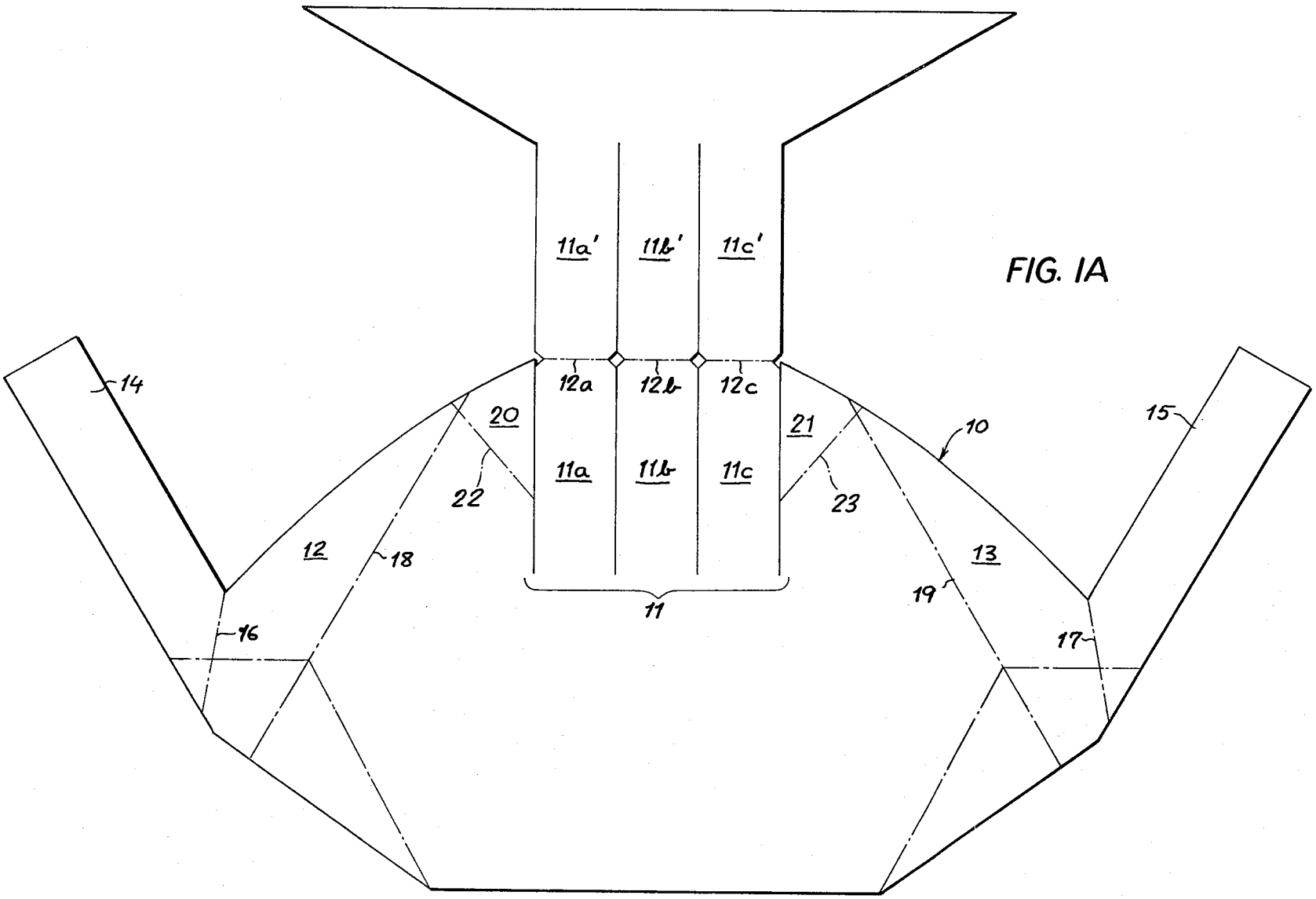
FIG. 1A is a face view of an integral blank of sheet material designed to form the front piece and most of the rear sheeting of a baseball glove embodying my invention.

In FIG. 1A I have shown a unitary blank 10 of leather or the like which has a central portion 11 flanked by two wings 12, 13 and gores 20, 21 bounded by crease lines 22 and 23, respectively, the entire blank being symmetrical about a vertical centerline. Central portion 11 is split into three sections 11*a*, 11*b*, 11*c* with mirror-symmetrical extensions 11*a'*, 11*b'*, 11*c'*which are integrally joined at their roots and are foldable about transverse lines 12*a*, 12*b*, 12*c* to form the stalls for an index finger, a middle finger and a ring finger, respectively. Wings 12 and 13 have strip-like extensions 14 and 15 which can be alternately folded along with the respective gore around the adjoining crease lines or, together with the respective wing, about crease line 18 and 19. Thus, one strip provides a backing for a web pad 25 and for part of a rearwardly open thumb stall, as illustrated for strip 14 and gore 20 in FIG. 1B, while the other forms a hand-engaging strap linked with a rearwardly open stall for the little finger as shown for wing 13 and strip 15. Patches 26*a*, 26*b*, attached to sheet 10 and pag 25 by lacings 24*a*, 24*b*, hold the thumb and the little finger in place against protective heel pads 27, 28 which lie partly in the respective stalls and are interconnected by a short lace 24*c*. In the right-handed glove shown in FIGS. 1B and 1C, strip 14 as well as gore 20 and pag 25 are linked by lacing 24*d* to the index-finger stall formed from blank sections 11*a* and 11*a'*; similar lacing 24*e* connects wing 13 with the ring-finger stall formed from blank sections 11*c* and 11*c'*. These lacings pass through perforations of blanks 10 designed for right-hand use; similar perforations (not shown), designed for left-hand use, are unutilized in the glove of FIGS. 1B and 1C. The sheet sections 11*a*, 11*b* and 11*c* are stitched to their extensions 11*a'*, 11*b'*and 11*c'*by seams 29*a*, 29*b* and 29*c* to form the three centrally positioned finger stalls.

Figure 1B:
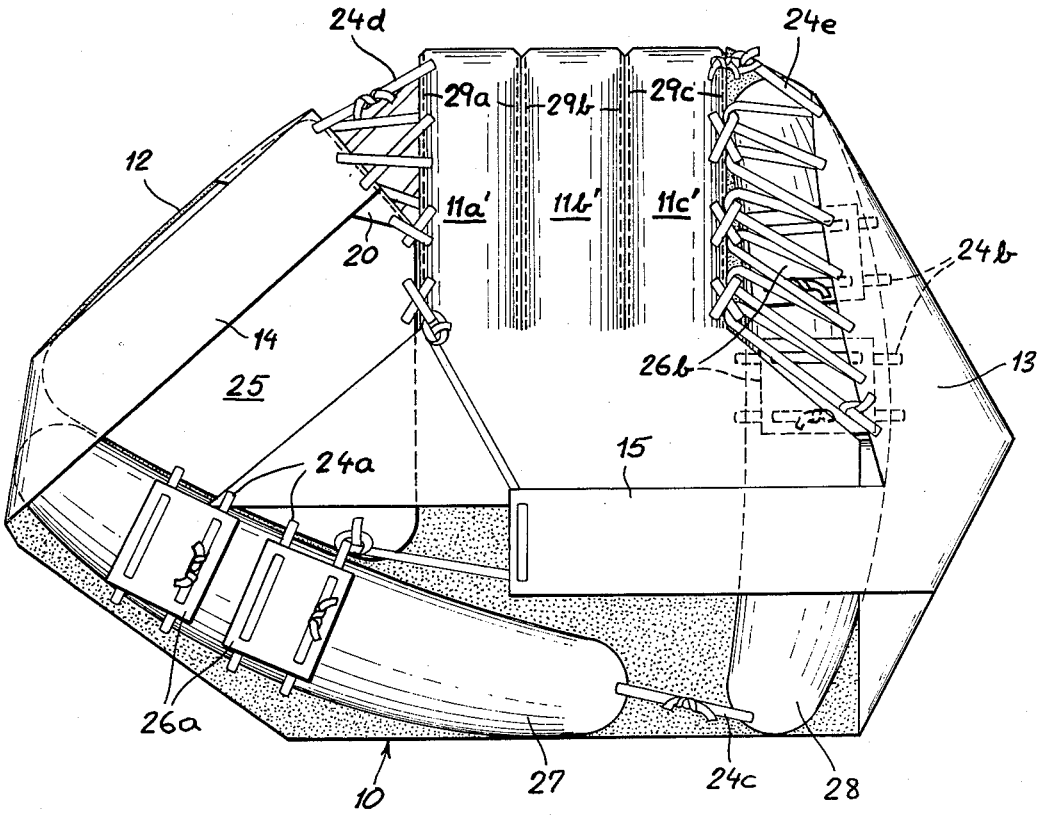
FIG. 1B is a view similar to FIG. 1A but showing a baseball glove formed from the blank of FIG. 1A folded and laced for right-hand use.
Figure 1C:
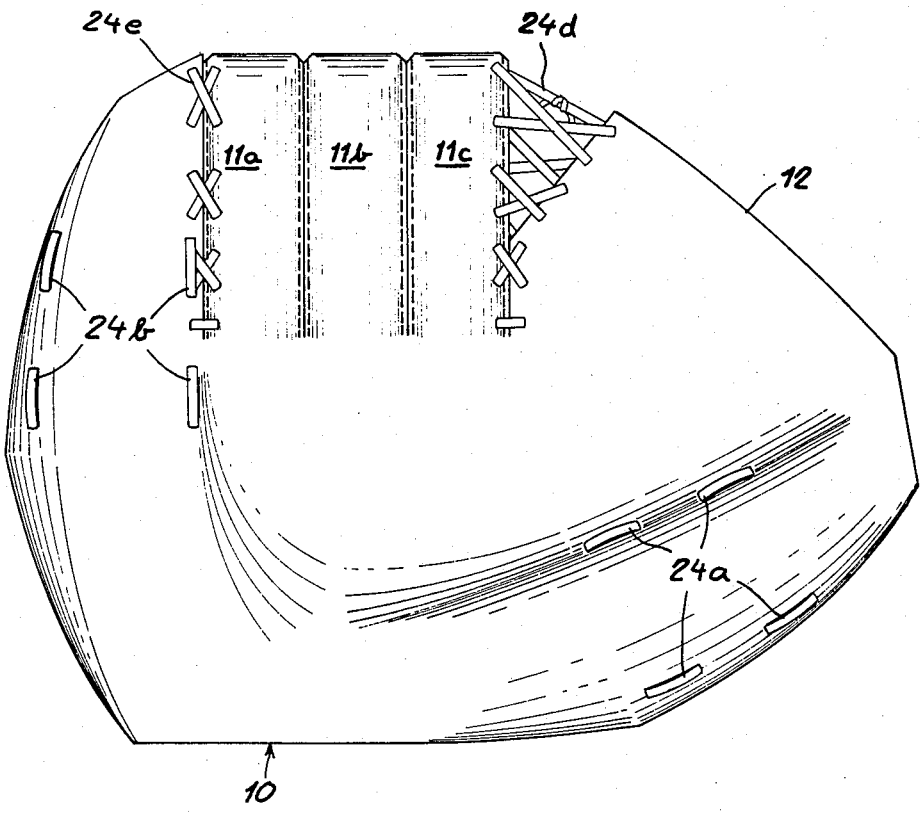
FIG. 1C is a rear view of the glove shown in FIG. 1B.

In FIGS. 1B and 1C the stall designed for the middle finger, formed from blank sections 11*b* and 11*b'*, is not laced to the adjoining stalls and is therefore freely movable. I may, however, replace lacings 24*d* and 24*e* by a single lace loosely interlinking also the three central stalls, generally as shown in FIG. 2 described below.

Figure 2:
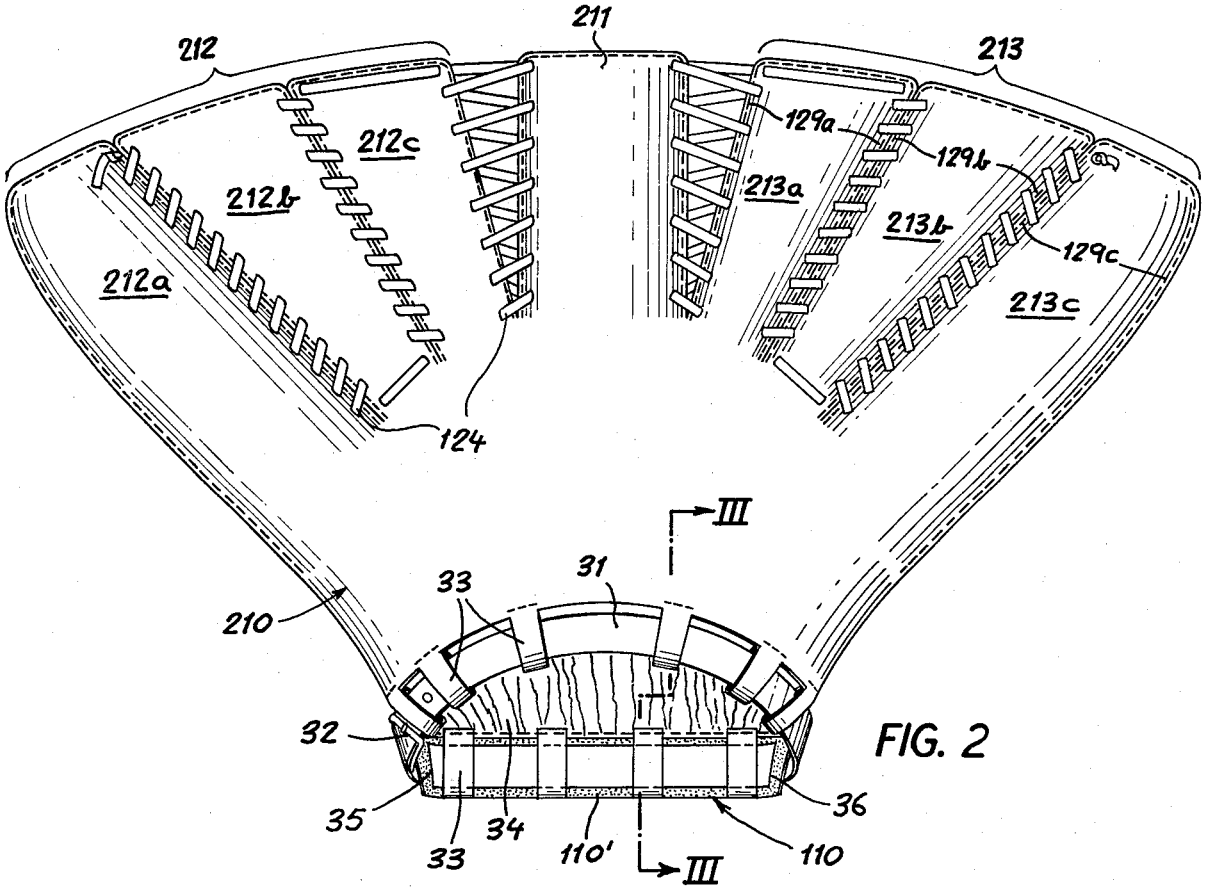
FIG. 2 is a rear view of a two-sheet baseball glove according to my invention.
Figure 3:
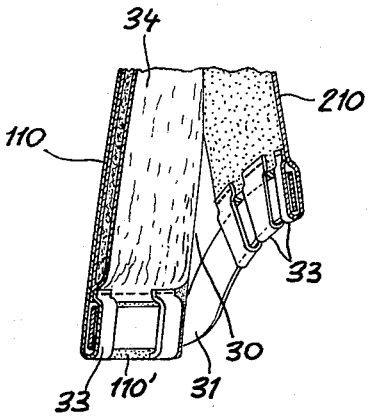
FIG. 3 is a fragmentary cross-sectional view taken on the line III—III of FIG. 2.

The embodiment of FIGS. 2 and 3 comprises a baseball glove formed from two largely coextensive blanks 110 and 210 respectively defining the front and the rear of the glove. Each blank in its flattened-out state is symmetrical about a vertical centerline bisecting a central section 211 designed to form a stall for the index finger, that central portion being flanked by two wings 212 and 213 each subdivided into three sections 212*a*, 212*b*, 212*c* and 213*a*, 213*b*, 213*c* as particularly illustrated in FIG. 2 for the rear sheet 210. All seven sections are held together by continuous lacing 124 but can be limitly separated in one or the other wing, by tugging at the linking lace portions but without relacing, to form three independent stalls for the middle, ring and little fingers. Such separation, of course, tightens the linkages in the opposite wing to unite its sections into a thumb stall and a closely adjoining web which in turn could be firmly tied to the central section accommodating the index finger . The stalls are laterally closed by seams such as those illustrated at 129*a*, 129*b*, 129*c* for sections 213*a*, 213*b*, 213*c*; peripheral seams of the outermost stalls terminate above the lower boundary of each sheet to leave an air-circulation gap as indicated at 30 in FIG. 3.

A wristband 31, closed by a lateral buckle 32 into an endless strap of adjustable length, passes through a set of loops 33 and loosely joins the front and rear pieces 110 and 210 together at the lower boundaries of their heel protions; the front portion of this band is concealed by a folded-over part 110′ of sheet 110, its rear section curving upward at the rear of the glove so as to be offset from the front section in the direction of the finger stalls. Padding 34 lines the inner surface of front piece 110 and extends into all five finger stalls; such padding may also be used as a liner for sheet 10 in the embodiment of FIGS. 1 and 2. The loops 33 hang down from the rear piece 210 but are turned upward along the inner surface of part 110′ which has slots 35, 36 traversed by the band 31; these front loops are also held in their upturned position by stitching.

The glove of FIGS. 2 and 3 may be somewhat simplified by a reduction of the number of stall-forming sheet sections from seven to six. Thus, I may omit the stall including central section 211 of FIG. 2 and move the adjoining sections 212*c* and 213*a* closer together to accommodate the index and middle fingers of the player. In that case the web will be reduced to one section of each sheet, i.e. section 212*b* or 213*b* and its respective mate on sheet 110, with section 212*a* or 213*c* forming the rear half of the thumb stall as in the illustrated seven-section embodiment. The advantage of an easy changeover between left-hand and right-hand use, without replacing, will of course be retained with that modification. It will be understood that the two identically shaped sheets 110 and 210 could be reversed so that sheet 210 becomes the front piece of the glove, with readjustment of the loops 33 and withdrawal of the band 31 from slots 35, 36, the band being then inserted into the counterparts of these slots in sheet 210 whose lower edge and loops are upturned in the manner shown for sheet 110 in FIG. 3. The padding 34 will then, of course, come to lie against sheet 210; upon deformation by the hand of the player, the rear sheet 110 will then appear shorter than the front sheet 210 in a view analogous to that of FIG. 3.

I claim:

1. In the baseball glove comprising a front piece of tough flexible sheet material and rear sheeting defining with said front piece a thumb stall and four other finger stalls together with a web between said thumb stall and the finger stall proximal thereto, the improvement wherein said front piece consists of an integral blank which is a flattened-out state is symmetrical about a central portion forming part of at least one of said other finger stalls, said central portion being flanked by two wings one of which forms part of said thumb stall and side web while the other forms part of at least a stall for the little finger, said web being joined by lacing to the finger stall proximal thereto.

2. The improvement defined in claim 1 wherein said central portion is slitted to define the front parts of three stalls respectively accommodating the index finger, the middle finger and the ring finger of a player.

3. The improvement defined in claim 2 wherein the rear parts of said three stalls are formed by integral extensions of said front parts folded about transverse edges which come to lie close to the tips of the player's fingers.

4. The improvement defined in claim 2 or 3 wherein said rear sheeting includes a pair of end strips extending integral from said wings, one of said end strips being folded over behind the corresponding wing to form a backing for the thumb stall and the web, the other of said end strips being folded over behind a heel portion of said front piece to form a hand-engaging strap.

5. The improvement defined in claim 4 wherein said rear sheeting includes patches laced to siad front piece partly closing the stalls for the thumb and the little finger from the rear.

6. The improvement defined in claim 1 wherein said rear sheeting consists of a second integral blank which in a flattened-out state is symmetrical about a centerline and has at least six sections complementing respective sections of the first blank aligned therewith to form five finger stalls and at least one additional stall, all said stalls being interconnected by lacing enabling relative shifting thereof for firmly linking an outermost stall with an adjoining stall to form said thumb stall and web while providing limited relative mobility for the remaining stalls.

7. The improvement defined in claim 6 wherein said stalls include a central stall accommodating a player's index finger, two adjoining stalls on either side of said central stall being firmly connectable to each other and to an adjacent thumb stall to constitute the web.

8. The improvement defined in claim 1, 6 or 7, further comprising a wristband interconnecting a heel portion of said front piece and part of said rear sheeting.

9. The improvement defined in claim 8 wherein said heel portion is folded inward to envelop a front section of said wristband, the latter having a rear section offset from said front section in the direction of said finger stalls.

* * * * *